US007186144B1

(12) United States Patent
Khemakhem et al.

(10) Patent No.: US 7,186,144 B1
(45) Date of Patent: Mar. 6, 2007

(54) CONNECTOR INCLUDING MEDIA CONVERTER

(75) Inventors: M'Hamed Anis Khemakhem, Eden Prairie, MN (US); Joseph C. Coffey, Burnsville, MN (US); Jeffrey Louis Peters, Eagan, MN (US); Hervé Fauvelet, Boississe le Roi (FR)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/291,522

(22) Filed: Dec. 1, 2005

(51) Int. Cl.
*H01R 13/66* (2006.01)

(52) U.S. Cl. ..... 439/620.03; 439/76.1; 439/581

(58) Field of Classification Search ..... 439/76.1, 439/620.03, 581
See application file for complete search history.

(56) References Cited

U.S. PATENT DOCUMENTS 3,792,284 A * 2/1974 Kaeilin ..... 250/551
3,803,409 A * 4/1974 Prochazka ..... 250/227.24
3,809,908 A * 5/1974 Clanton ..... 250/551
3,878,397 A * 4/1975 Robb et al. ..... 250/551
4,158,478 A * 6/1979 D'Auria et al. ..... 385/101
4,236,086 A * 11/1980 Hoebel ..... 307/149
4,595,839 A * 6/1986 Braun et al. ..... 250/551
4,684,210 A * 8/1987 Matsunaga et al. ..... 385/88
4,691,386 A * 9/1987 Eumurian et al. ..... 398/139
4,720,630 A * 1/1988 Takeuchi et al. ..... 250/551
4,733,934 A * 3/1988 Wais et al. ..... 385/89
4,756,593 A * 7/1988 Koakutsu et al. ..... 385/139
4,767,168 A * 8/1988 Grandy ..... 385/53
5,005,939 A * 4/1991 Arvanitakis et al. ..... 385/53
5,140,659 A * 8/1992 Minds et al. ..... 385/66
5,242,315 A * 9/1993 O'Dea ..... 439/577
5,268,971 A * 12/1993 Nilsson et al. ..... 385/101
5,285,512 A * 2/1994 Duncan et al. ..... 385/94
5,325,453 A * 6/1994 Drissler ..... 385/75
5,448,676 A * 9/1995 White et al. ..... 385/88
5,461,688 A * 10/1995 Lee ..... 385/75
5,734,558 A * 3/1998 Poplawski et al. ..... 361/752
5,967,852 A 10/1999 Follingstad et al.
6,000,856 A * 12/1999 Yunker ..... 385/75
6,078,712 A * 6/2000 Tschope et al. ..... 385/101
6,115,159 A 9/2000 Baker
6,164,838 A * 12/2000 Maehara et al. ..... 385/92
6,165,019 A * 12/2000 Kha et al. ..... 439/620.03

(Continued)

OTHER PUBLICATIONS

Telecast Fiber Systems, Inc., SHED™, SMPTE Hybrid Elimination Devices, 2003, pp. 1-2.

(Continued)

*Primary Examiner*—Ross Gushi
(74) *Attorney, Agent, or Firm*—Merchant & Gould P.C.

(57) ABSTRACT

A triaxial connector assembly including a media converter that is used to terminate a fiber optic/electrical hybrid cable is disclosed. The triaxial connector assembly includes a connector with a housing defining a first end and a second end, the first end of the housing defining a triaxial interface adapted to mate with a triaxial connector, the second end of the housing defining a cable termination end. The connector also includes the media converter positioned within the housing, the media converter configured to convert fiber signals and electrical signals carried by a hybrid fiber optic/electrical cable to a coaxial signal carried forward by the triaxial interface. A camera system using the connector and a method of terminating a hybrid cable to a triaxial connector are also disclosed.

16 Claims, 4 Drawing Sheets

U.S. PATENT DOCUMENTS

| | | | | |
|---|---|---|---|---|
| 6,179,627 | B1 * | 1/2001 | Daly et al. | 439/76.1 |
| 6,203,333 | B1 * | 3/2001 | Medina et al. | 439/76.1 |
| 6,305,849 | B1 * | 10/2001 | Roehrs et al. | 385/59 |
| 6,334,012 | B1 * | 12/2001 | Yoon et al. | 385/24 |
| 6,350,063 | B1 * | 2/2002 | Gilliland et al. | 385/88 |
| 6,380,826 | B1 * | 4/2002 | Palinkas | 333/175 |
| 6,416,334 | B1 * | 7/2002 | Plishner | 439/75 |
| 6,434,308 | B1 * | 8/2002 | Trezza | 385/119 |
| 6,575,786 | B1 | 6/2003 | Khemakhem et al. | |
| 6,718,113 | B2 * | 4/2004 | Mine et al. | 385/139 |
| 6,719,461 | B2 | 4/2004 | Cull | |
| 6,758,693 | B2 * | 7/2004 | Inagaki et al. | 439/577 |
| 6,874,946 | B2 * | 4/2005 | Cull | 385/71 |
| 6,974,262 | B1 * | 12/2005 | Rickenbach | 385/88 |
| 7,013,088 | B1 * | 3/2006 | Jiang et al. | 398/139 |
| 7,090,509 | B1 * | 8/2006 | Gilliland et al. | 439/76.1 |
| 2002/0126967 | A1 * | 9/2002 | Panak et al. | 385/101 |
| 2002/0177367 | A1 * | 11/2002 | Mine et al. | 439/669 |
| 2003/0113071 | A1 * | 6/2003 | Kim et al. | 385/76 |
| 2004/0033028 | A1 * | 2/2004 | Cheng | 385/55 |
| 2004/0105630 | A1 * | 6/2004 | Cheng et al. | 385/89 |
| 2004/0105631 | A1 * | 6/2004 | Cheng et al. | 385/89 |
| 2005/0078918 | A1 * | 4/2005 | Wang | 385/92 |
| 2005/0215113 | A1 | 9/2005 | Khemakhem | |
| 2005/0276547 | A1 * | 12/2005 | Wang et al. | 385/92 |
| 2006/0088251 | A1 * | 4/2006 | Wang et al. | 385/88 |
| 2006/0110164 | A1 * | 5/2006 | Cook et al. | 398/135 |

OTHER PUBLICATIONS

Telecast Fiber Systems, Inc., Cobra™, Triax-to-Fiber Camera Interface—Now for High Definition and High Speed Cameras, 2003, pp. 1-2.

HDC-900/950/930 Series Product Information Manual, Chapter 5 Optical Fiber Connector and Cable, pp. 64-65, Date Unknown (admitted as prior art as of filing date).

LEMO® USA, LEMO Connectors/Browse-Group, Metal Connectors, Nov. 7, 2005, pp. 1-3.

LEMO® USA, LEMO Connectors/Browse-Group, Plastic REDEL® Connectors, Nov. 7, 2005, p. 1.

LEMO® USA, LEMO Connectors/Products & Services—Connector Guide, Nov. 7, 2005, p. 1.

STRATOS, Stratos Lightwave Products: Search!, Nov. 7, 2005, pp. 1-3.

Telecast Fiber Systems, Inc., Telecast—Products: Cobra Series, Nov. 7, 2005, pp. 1-2.

* cited by examiner

CONNECTOR INCLUDING MEDIA CONVERTER

TECHNICAL FIELD

The present invention relates generally to telecommunications connectors. More particularly, the present invention relates to a coaxial or triaxial connector including a media converter that is used to terminate a fiber optic/electrical hybrid cable.

BACKGROUND

In the broadcast industry, certain devices such as television cameras, particularly high performance cameras used in program production, can be remotely controlled and powered from a local or distant camera control unit (CCU), sometimes called a base station. There are two prominent types of transmission mediums (i.e., cables) in the industry for carrying signals between the CCU and the camera. One type is a triaxial cable and the other is an fiber optic/electrical hybrid cable. Both of these cable types are used to power the camera and transmit video, audio, and data signals from and to the camera.

Triaxial cables and triaxial connectors are the more traditional media used in the industry. A triaxial cable and corresponding connector consists of three conductors. The triaxial structure is a coaxial design with an extra conductive shield. On a triaxial structure, the center pin carries all signals from and to the camera. These signals vary with the camera type and sophistication. For example, the signals coming from the camera may include, but are not limited to, video, intercom, and audio. The signals going to the camera may include, but are not limited to, program audio, intercom, teleprompter feed, and data for controls. These signals may be analog, such as AM or FM, and/or digital in nature.

The signals are typically carried simultaneously bi-directionally between the CCU and the camera. Since there is typically only one physical cable, it is the function of the triaxial adapter of the camera system to encode and/or modulate the required video, audio, intercommunications, and data signals onto the proper frequencies. The different signals are demodulated to allow them to be carried on the center pin in both directions. The different frequencies are specified by the camera manufacturers.

The center pin also carries the power from the CCU to the camera. The middle shield of the triaxial cable is used as the power shield. The outer conductor is used as a protection shield. Camera voltage varies from one manufacturer to another and from one model to another. The most common voltages used in the industry are 250 Volts AC and 140 Volts DC. The power needed to power the camera, however, is normally no more than 10–17 Volts DC.

The triaxial structure is a robust structure. The triaxial camera connectors and cables are large and capable of being used in harsh environments, such as at sporting events. The triaxial structure has been in the market for a long time due to its ruggedized structure. Many improvements have been made to the triaxial connectors over the years. There are several major triaxial connector interfaces in the world terminating the same type of a triaxial cable. U.S. Pat. Nos. 6,575,786 and 5,967,852 show triaxial connectors including the end structures to connect to mating triaxial connectors.

However, the triaxial structure has its drawbacks. The operating distance of existing triaxial systems is limited. For example, a high definition (HD) signal can be transmitted over a triaxial structure for a maximum of only about 2500 ft. Since the trend in the industry has been toward cameras having higher performance and wider information bandwidths, other solutions are being explored.

The second type of a transmission medium, designed to compensate for the limitations of the triaxial cable, is an electrical/fiber optic hybrid medium. There are several hybrid camera connectors available in the industry for terminating a hybrid cable. Many use the SMPTE 311M standard. The type of signal needed remains the same as for the triaxial system. Typically, the hybrid SMPTE cable carries two fiber signals, one for transmitting and one for receiving, two copper signals for intercom, and two copper signals for power.

The hybrid cable has been favored for HD applications. It allows the signal to be carried over longer distances than on the triaxial cable structure. Generally, signals can travel further over fiber optic cables compared to copper cables. However, the hybrid system is not without its drawbacks also. The hybrid connectors that are used to terminate the hybrid cable are expensive and are not designed for harsh environments, making them often unreliable. Moreover, since the traditional triaxial structure has been adopted as the main camera standard in the broadcast industry, there are significant costs involved with investing in new cameras, CCU's and supporting infrastructure to accommodate hybrid connectors.

One solution provided in the industry has been to combine the advantages of the two types of cabling systems. FIG. 1 shows a prior art arrangement 10 that uses both a triaxial medium and an electrical/fiber optic hybrid medium between the camera and the CCU.

Referring to FIG. 1, in addition to a camera 12 and a CCU 14, the prior art camera system 10 generally includes a camera control interface unit 16, a camera interface unit 18, and a fiber optic cable 20. Control interface unit 16 is linked to CCU 14 using a triaxial cable 22. Similarly, camera interface unit 18 is linked to camera 12 using a triaxial cable 24. Control interface unit 16 and camera interface unit 18 each provide an electro/optical and opto/electrical conversion function. Control interface unit 16 converts electrical signals received from CCU 14 on triaxial cable 22 to provide an optical signal on fiber optic cable 20. The optical signal is transmitted on fiber-optic cable 20 to camera interface unit 18 where it is converted back to an electrical signal and passed to camera 12 on triaxial cable 24. In a similar manner, camera interface unit 18 converts the electrical signal received from camera 12 on triaxial cable 24 to provide an optical signal which is transmitted on fiber optic cable 20 to control interface unit 16. Control interface unit 16 converts the optical signal back to an electrical signal for transmission to CCU 14 on triaxial cable 22. Example camera interface units and/or control interface units such as herein described are available from Telecast Fiber Systems, Inc.

A system such as system 10 illustrated in FIG. 1 is complicated and costly. In addition to the camera 12 and the CCU 14, the system requires a control interface unit 16, a camera interface unit 18, and a total of twelve different connectors (eight triaxial and four fiber optic or hybrid connectors) to provide the connections. The connectors include one triaxial connector 26 located on the CCU 14, two triaxial connectors 28, 30 terminated to the ends of the triaxial cable 22 extending between the control interface unit 16 and the CCU 14, one triaxial connector 32 located on the control interface unit 16, one fiber optic or hybrid connector 34 located on the other side of the control interface unit 16, two fiber optic or hybrid connectors 36, 38 terminated to the ends of the fiber optic or hybrid cable 20 extending between the control interface unit 16 and the camera interface unit 18, one fiber optic or hybrid connector 40 located on the camera interface unit 18, one triaxial connector 42 located on the other side of the camera interface unit 18, two triaxial connectors 44, 46 terminated to the ends of the triaxial cable 24 extending between the camera interface unit 18 and the camera 12, and one triaxial connector 48 located on the camera 12. An example of a fiber optic/electrical connector such as the one in the prior art system of FIG. 1 is available from LEMO USA, Inc.

What is needed is a system that uses the more durable, traditional triaxial interface while allowing the signal to be carried over distances achievable only by fiber media. What is needed in the industry is a solution that enhances the operating distance of existing and new triaxial camera systems without having to modify existing camera and CCU hardware.

SUMMARY

The present invention relates generally to telecommunications systems and connectors. More particularly, the present invention relates to a connector that is used to terminate a fiber optic/electrical hybrid cable.

According to one aspect of the invention, there is provided a system that enhances the operating distance of triaxial camera systems without having to modify the camera and CCU hardware.

According to another aspect of the invention, there is provided a system that uses the more durable triaxial interface, eliminates a fragile fiber interface, and still allows signals to be carried by fiber media.

According to yet another aspect of the invention, there is provided a system that uses less cabling/connectors than those solutions offered by prior art systems.

According to yet another aspect of the invention, there is provided a system that allows standard and HD camera and CCU manufacturers to adopt and standardize on one type of a connector interface.

In one particular aspect, a triaxial connector including a media converter that is used to terminate a fiber optic/electrical hybrid cable is disclosed. The connector includes a housing defining a first end and a second end, the first end of the housing defining a triaxial interface adapted to mate with a triaxial connector, the second end of the housing defining a cable termination end, the media converter positioned within the housing, the media converter configured to convert fiber signals and electrical signals carried by a fiber optic/electrical hybrid cable to a coaxial signal.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 2:
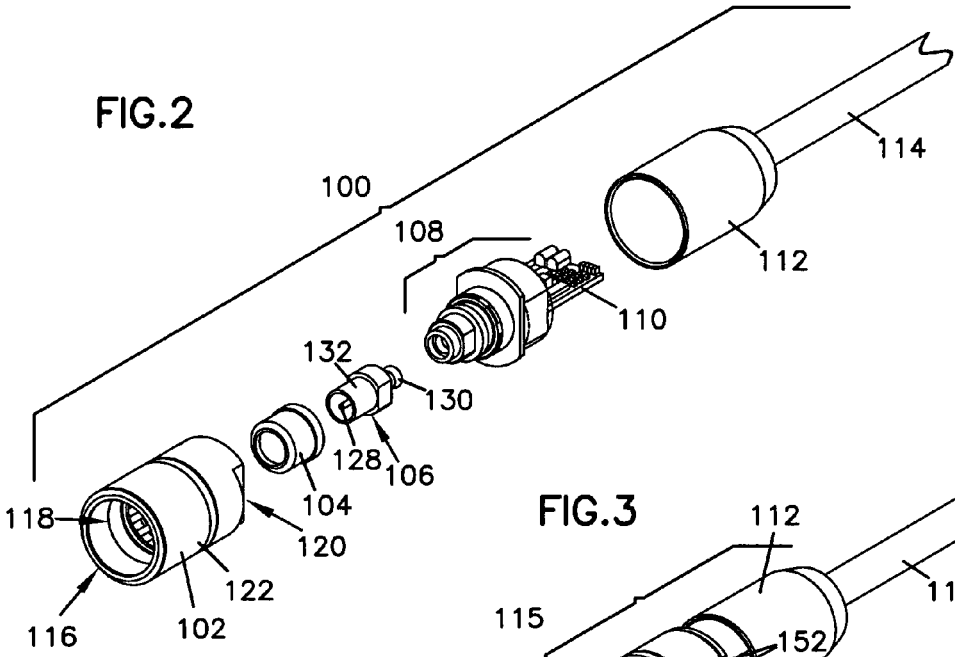
FIG. 2 is an exploded view of a connector having features that are examples of inventive aspects in accordance with the principles of the present disclosure, the connector shown terminated to a fiber optic/electrical hybrid cable.

Referring to FIG. 2, connector 100 includes an outer body 102, an outer insulator 104, a front shell assembly 106, a converter assembly 108 that includes a media converter 110, and an end cap 112. Connector 100 is terminated to a fiber optic/electrical hybrid cable 114.

Figure 1:
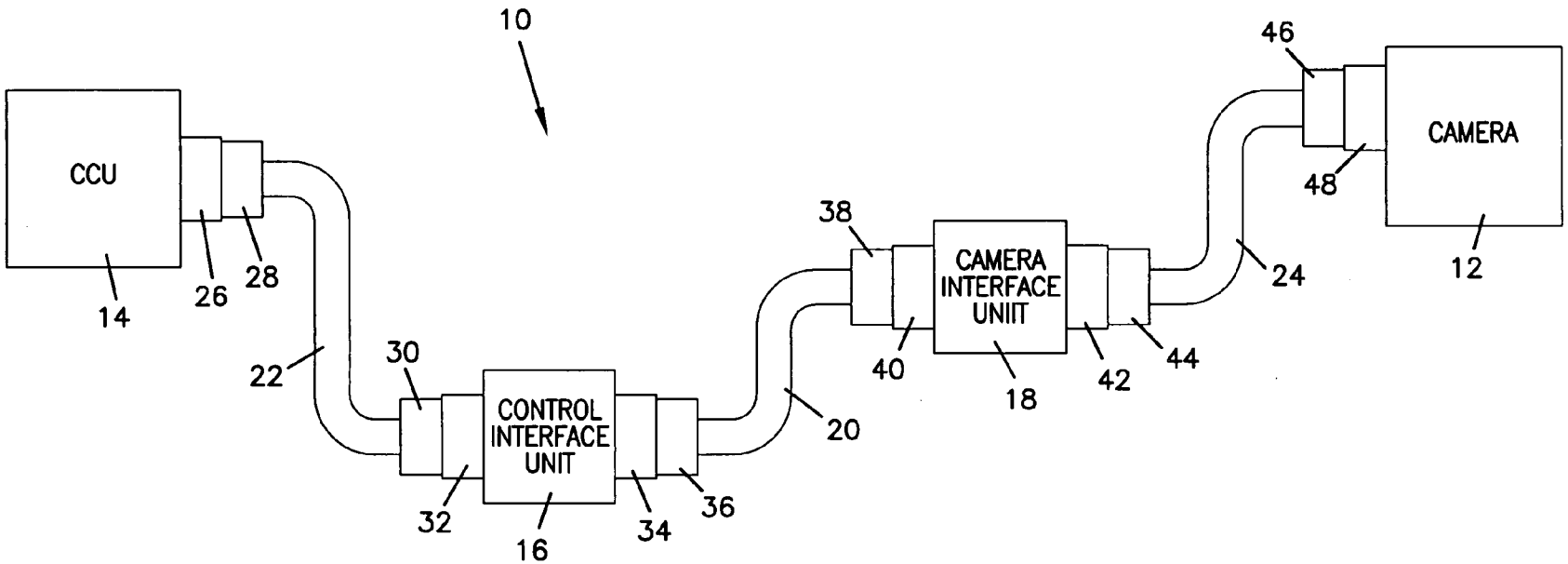
FIG. 1 (PRIOR ART)
FIG. 1 is a schematic view of a prior art camera system.
Figure 1A:
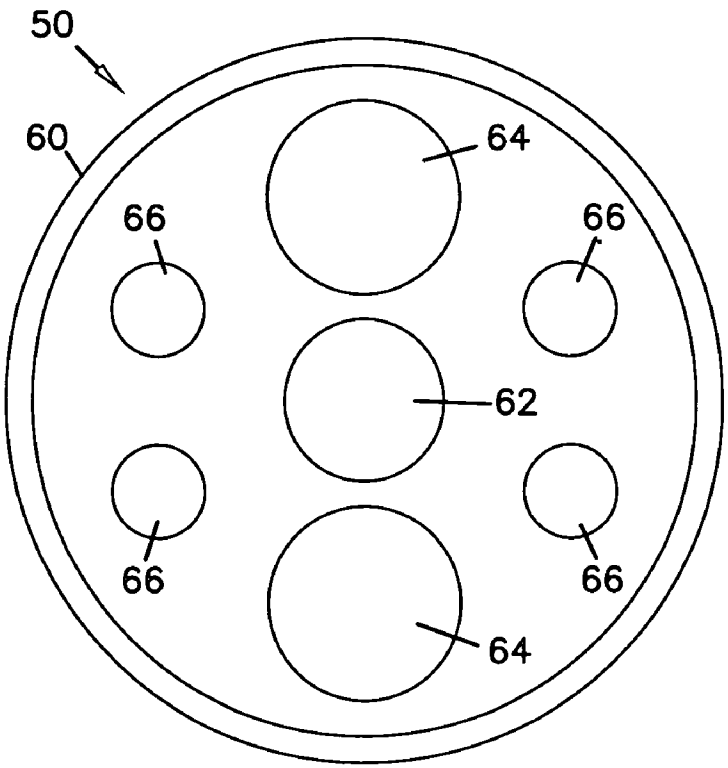
FIG. 1A (PRIOR ART)
FIG. 1A is a schematic cross-sectional view of a prior art hybrid fiber optic/electrical cable including two fiber lines and four electrical lines.

One example of a fiber optic/electrical hybrid cable 114 that may be terminated to connector 100 in accordance with the invention is a conventional SMPTE type hybrid cable. An example SMPTE cable 50 is shown in FIG. 1A. Cable 50 includes an outer sheath 60 and may include a linearly extending central strength member 62. The SMPTE hybrid cable 50 may include two fiber lines 64 (one for transmitting signals and one for receiving signals), and four copper lines 66, two for intercom, and two for power.

Figure 3:
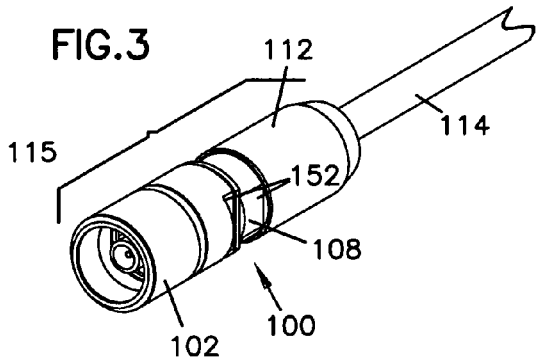
FIG. 3 illustrates the connector of FIG. 2 in an assembled configuration.

Once assembled as shown in FIG. 3, connector 100 defines a housing 115 that houses the various components therewithin. Connector 100 is assembled by coupling front shell assembly 106 to converter assembly 108, placing outer insulator 104 over front shell assembly 106, coupling outer body 102 to converter assembly 108 and coupling converter assembly 108 to end cap 112, wherein converter assembly 108 is captured between outer body 102 and end cap 112. End cap 112 provides a strain relief function between connector 100 and cable 114.

Referring to FIGS. 2 and 3, outer body 102 of connector 100 includes a first end 116 that defines a triaxial interface 118 and a second end 120 that is adapted to be coupled to converter assembly 108, as will be discussed in further detail below. A converted coaxial signal is carried from converter assembly 108 to triaxial interface 118 of outer body 102, wherein this signal can then be transmitted forward to another mating triaxial connector. Outer perimeter 122 of outer body 102 is generally cylindrical in shape. Converter assembly 108 is preferably shaped and sized such that it does not radially project past outer perimeter 122. In this manner, the generally cylindrical shape of the overall triaxial housing 115 is preserved while the termination terminals 124, 126 (See FIG. 4) of media converter 108 are also protected within housing 115. Preferably, media converter 108 is sealed within triaxial housing 115 from water and debris. It should be noted that in other embodiments, the converter assembly can be of other shapes and may project radially past the outer perimeter 122.

As mentioned previously, there are several major triaxial connector interface styles in the world terminating the same type of a triaxial cable. Typical genders are defined as male and female, while some of the different styles include Global, U.S., BBC, and others. The connectors of a particular style are normally physically directly compatible with only the connectors of the same style. For example, a male Global style triaxial connector may not mate with a female U.S. style triaxial connector.

It should be noted that although connector 100 illustrated and described in FIGS. 2–3 is a female U.S. style connector, converter assembly 108 can be mounted to other styles or genders if desired. As described in commonly owned U.S. application Ser. No. 10/809,665, filed Mar. 25, 2004, entitled TRIAXIAL CONNECTOR ADAPTER AND METHOD, and U.S. Pat. Nos. 6,575,786 and 5,967,852, the entire disclosures of which are hereby incorporated by reference, with the use of different front shell assemblies and outer insulators, converter assembly 108 can be fitted to different styles or genders of triaxial connectors as needed. The connectors may be sold or provided with kits so that any gender or style will be readily available for terminating hybrid cable 114. These kits can also be used to replace broken or worn parts of the triaxial connector end.

Referring to FIG. 2, front shell assembly 106 includes a center conductor 128, a center conductor insulator 130 and a front shell 132. Once front shell assembly 106 is coupled to converter assembly 108, outer body 102 of connector 100 is mounted about and electrically isolated from front shell assembly 106 by outer insulator 104.

Figure 4:
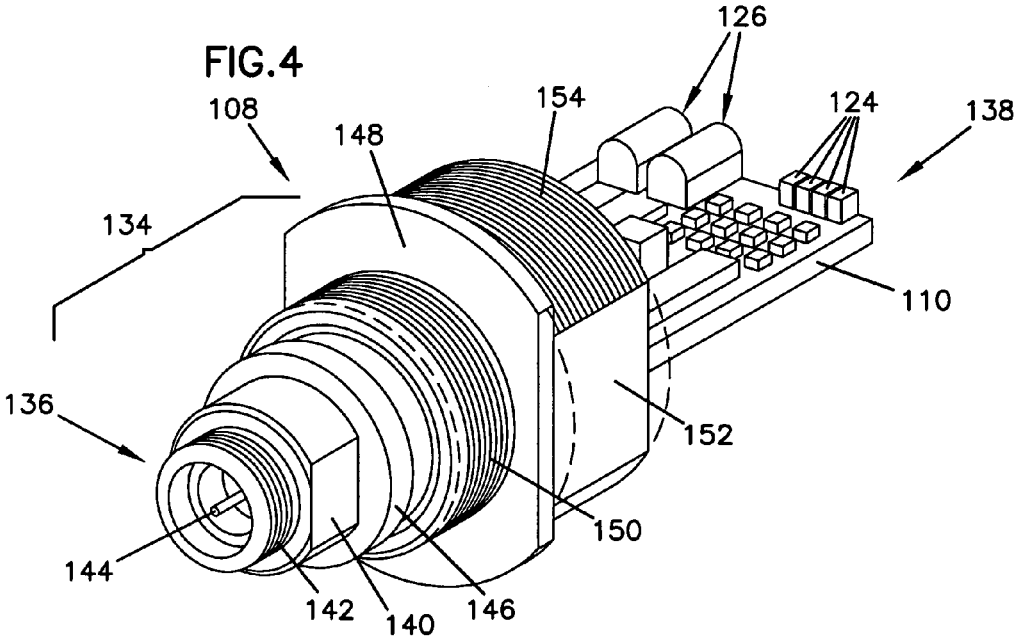
FIG. 4 illustrates a close-up view of the converter assembly of the connector of FIG. 2.

Now referring to FIG. 4, converter assembly 108 of connector 100 is illustrated in closer detail. Converter assembly 108 includes a coax interface 134 at a first end 136 and the media converter 110 at a second end 138.

Media converter 110 includes four copper terminals 124 and two fiber terminals 126. This configuration is adapted for terminating a SMPTE type hybrid cable, which includes four copper lines and two fiber lines for carrying signals between the camera and the CCU. Media converter 110 converts the fiber signals and the copper signals coming from hybrid cable 114 into a coaxial signal and vice versa. The coaxial signal can then be carried forward by the coax interface 134 to the triaxial interface 118 of outer body 102 of connector 100. In this manner, camera or CCU manufacturers can still use existing triaxial connectors without having to modify present units while employing the benefit of a fiber medium for long distance signal travel.

Media converter 110 is inserted within and fully protected by end cap 112 when connector 100 is assembled. This configuration provides for an advantageous design since the fiber and copper terminals 124, 126 of media converter 110 are protected within housing 115 of connector 100. Power needed for the media conversion can be drawn from the power carrying lines of cable 114.

Still referring to FIG. 4, the coax interface 134 includes a first outer conductive shell 140 with an outer threaded portion 142 at first end 136. A center conductor 144 is positioned within first outer conductive shell 140. First outer conductive shell 140 is mounted within an insulator 146 which is mounted within a converter assembly housing 148. Converter assembly housing 148 includes a threaded portion 150 toward first end 136. Converter assembly housing 148 is electrically conductive and electrically isolated from first outer conductive shell 140 by insulator 146. Front shell assembly 106 (FIG. 2) is mounted to the coax interface 134 of converter assembly 108 by threading onto threaded portion 142. When front shell assembly 106 is mounted to converter assembly 108, center conductor 128 of front shell assembly 106 is electrically connected with center conductor 144 of converter assembly 108 and front shell 132 is electrically connected to first outer conductive shell 140 of converter assembly 108.

Outer body 102 (FIG. 2) is mounted to the converter assembly 108 by threading onto threaded portion 150 of converter assembly housing 148. When outer body 102 is mounted to converter assembly 108, outer body 102 is electrically connected to converter assembly housing 148. Converter assembly housing 148 and outer body 102 also each include a plurality of opposing wrench flats 152 to aid in assembly and disassembly. Outer body 102, outer insulator 104, front shell assembly 106, and converter assembly 108 cooperate to form triaxial interface 118. U.S. application Ser. No. 10/809,665, filed Mar. 25, 2004, entitled TRIAXIAL CONNECTOR ADAPTER AND METHOD, and U.S. Pat. Nos. 6,575,786 and 5,967,852, noted above, shows various triaxial interfaces for connecting to cameras, CCU's and other devices.

The coax interface 134 of converter assembly 108 is similar in structure to the triaxial connectors described in U.S. application Ser. No. 10/809,665, filed Mar. 25, 2004, entitled TRIAXIAL CONNECTOR ADAPTER AND METHOD, and U.S. Pat. Nos. 6,575,786 and 5,967,852, noted above.

Converter assembly housing 148 also includes a threaded portion 154 toward second end 138 for threadingly mating with end cap 112. When converter assembly 108 is threaded to end cap 112, media converter 110 is captured within and fully protected by end cap 112. The fiber and copper terminals 124, 126 of media converter 110 are terminated to the electrical and fiber lines of hybrid cable 114 within end cap 112 and thus are fully protected by end cap 112. Gaskets can be provided between the various joined parts to seal the interior parts such as the components and connections of media converter 110.

Figure 5:
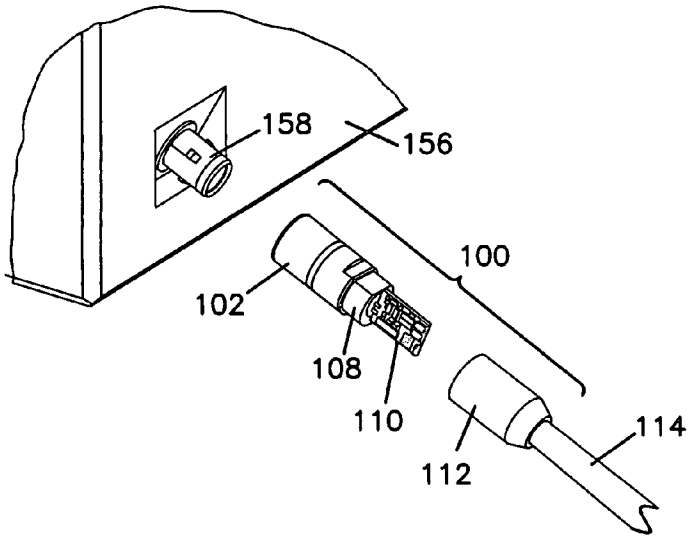
FIG. 5 illustrates a partial exploded view of the connector of FIG. 2 shown with a partial view of a camera or a CCU unit including a connector that mates with the connector of FIG. 2.

FIG. 5 shows a partially exploded view of connector 100 of the present invention with a partial view of a camera or a CCU unit 156 that includes a triaxial connector 158 that mates with connector 100. As discussed previously, with the connector of the present invention, there is no need to modify a camera or a CCU unit that includes a triaxial connector such as connector 158 as shown in FIG. 5 to utilize the system. Moreover, by having a media converter 110 that is fully enclosed within the triaxial housing 115, connector 100 of the present invention forms a ruggedized structure that also utilizes the signal carrying capacity of a fiber medium without exposing the fiber termination points 126 to harsh environments.

Figure 6:
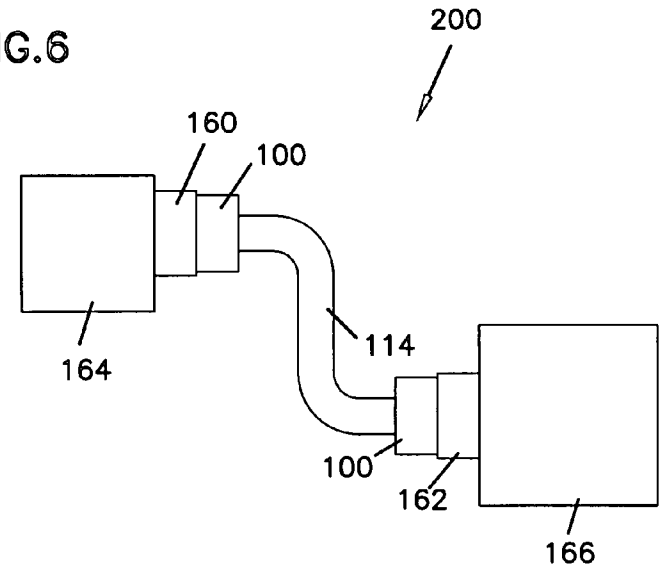
FIG. 6 is a schematic view of a camera system having features that are examples of inventive aspects in accordance with the principles of the present disclosure.

FIG. 6 illustrates a schematic view of a system 200 that utilizes the connector 100 of the present invention. System 200 illustrated in FIG. 6 includes two triaxial connectors 160, 162 (connector 160 provided on the camera 164 and connector 162 provided on the CCU 166) and includes a hybrid fiber optic/electrical cable 114 with connectors 100 of the present invention terminated at each end. Thus, unlike the prior art camera systems, system 200 of the present invention significantly reduces the number of components, cables, and connectors required and preferably uses four connectors and a single cable between a camera and a CCU unit.

The preferred embodiment includes triaxial interfaces. It is to be appreciated that coaxial interfaces can be utilized where the media converters are incorporated into coaxial connector housings in a similar manner as the triaxial connector housings noted above.

The embodiments of the inventions disclosed herein have been discussed for the purpose of familiarizing the reader with novel aspects of the present invention. Although preferred embodiments have been shown and described, many changes, modifications, and substitutions may be made by one having skill in the art without unnecessarily departing from the spirit and scope of the present invention. Having described preferred aspects and embodiments of the present invention, modifications and equivalents of the disclosed concepts may readily occur to one skilled in the art. However, it is intended that such modifications and equivalents be included within the scope of the claims which are appended hereto.

What is claimed is:

1. A connector comprising:

a housing defining a first end and a second end, the first end of the housing defining a triaxial interface adapted to mate with a triaxial connector, the second end of the housing defining a cable termination end;

a media converter positioned within the housing, the media converter configured to convert fiber signals and electrical signals carried by a fiber optic/electrical hybrid cable to a coaxial signal.

2. A connector according to claim 1, wherein the media converter includes four copper terminals and two fiber terminals for terminating a hybrid cable carrying four electrical lines and two fiber lines.

3. A connector according to claim 1, wherein the housing defines a generally cylindrical outer perimeter and the media converter does not radially project out past the outer perimeter.

4. A connector according to claim 1, further comprising a converter assembly including a coax interface at a first end and the media converter at a second end, the coax interface adapted to be electrically and physically connected to an outer body defining the triaxial interface and the media converter configured to transmit the converted signal to the triaxial interface through the coax interface.

5. A connector according to claim 4, wherein the housing includes a front portion defined by the outer body, and a second portion defining the second end wherein the front portion is threadably mounted to the second portion.

6. A connector according to claim 1, wherein the housing includes a front portion defining the first end, and a second portion defining the second end, wherein the first portion is removably mounted to the second portion.

7. A cable comprising:

a fiber optic/electrical hybrid cable carrying electrical lines and fiber lines, the hybrid cable including a first end and a second end;

a connector terminated to each of the first and second ends of the hybrid cable, each connector including a housing defining a first end and a second end, the first end of the housing defining a triaxial interface adapted to mate with a triaxial connector, the second end of the housing defining a cable termination end, each connector including a media converter positioned within the housing, the media converter configured to convert the fiber signals and electrical signals carried by the fiber optic/electrical hybrid cable to a coaxial signal.

8. A cable according to claim 7, wherein the hybrid cable carries four electrical lines and two fiber lines.

9. A cable according to claim 7, wherein the media converter includes four copper terminals and two fiber terminals.

10. A system comprising:

a telecommunications device including a first triaxial connector adapted to receive and transmit a triaxial signal; and a second triaxial connector connectable and disconnectable from the first triaxial connector, the second triaxial connector including a housing defining a first end and a second end, the first end of the housing defining a triaxial interface adapted to mate with the first triaxial connector, the second end of the housing defining a cable termination end, the second triaxial connector including a media converter positioned within the housing, the media converter configured to convert fiber signals and electrical signals carried by a fiber optic/electrical hybrid cable to a coaxial signal;

wherein the second triaxial connector is physically and electrically connectable to the first triaxial connector.

11. A system according to claim 10, wherein the telecommunications device includes a camera.

12. A system according to claim 10, wherein the telecommunications device includes a camera control unit.

13. A system according to claim 10, further comprising a hybrid cable connected to the second triaxial connector, the cable connected to a second telecommunications device.

14. A camera system comprising:

a camera control unit including a first triaxial connector;

a camera including a second triaxial connector; and a fiber optic/electrical hybrid cable carrying electrical lines and fiber lines, the hybrid cable including a first end and a second end, a connector terminated to each of the first and second ends of the hybrid cable, each connector including a housing defining a first end and a second end, the first end of the housing defining a triaxial interface adapted to mate with a triaxial connector, the second end of the housing defining a cable termination end, each connector including a media converter positioned within the housing, the media converter configured to convert the fiber signals and electrical signals carried by the fiber optic/electrical hybrid cable to a coaxial signal;

wherein the connector terminated to the first end of the hybrid cable is connected to the first triaxial connector of the camera control unit and wherein the connector terminated to the second end of the hybrid cable is connected to the second triaxial connector of the camera.

15. A method of connecting a fiber optic/electrical hybrid cable to a triaxial connector comprising the steps of:

providing a fiber optic/electrical hybrid cable carrying both electrical signals and fiber signals;

providing a first connector including a first end defining a triaxial interface and a second end including a media converter, the media converter configured to convert the fiber signals and the electrical signals to a coaxial signal carried forward through the triaxial interface of the first connector; and terminating the fiber optic/electrical hybrid cable to the media converter of the first connector.

16. A method of connecting a fiber optic/electrical hybrid cable to a triaxial connector comprising the steps of:

providing a fiber optic/electrical hybrid cable carrying both electrical signals and fiber signals;

providing a first connector including a first end defining a triaxial interface and a second end including a media converter, the media converter configured to convert the fiber signals and the electrical signals to a coaxial signal carried forward through the triaxial interface of the first connector;

providing a second connector including a first end defining a triaxial interface and a second end including a media converter, the media converter configured to convert the fiber signals and the electrical signals to a coaxial signal carried forward through the triaxial interface of the second connector;

providing the first and second connectors terminating the ends of the hybrid cable; and connecting a triaxial connector of a first device to a triaxial connector of a second device with the hybrid cable.

* * * * *